US009527708B2

(12) United States Patent
Ding et al.

(10) Patent No.: US 9,527,708 B2
(45) Date of Patent: Dec. 27, 2016

(54) SEGMENTED INVERTING COVER PLATE APPARATUS FOR UNDERFLOOR VEHICLE LIFTING JACK

(71) Applicant: CRRC QINGDAO SIFANG ROLLING STOCK RESEARCH INSTITUTE CO., LTD., Qingdao (CN)

(72) Inventors: Hui Ding, Qingdao (CN); Xiaodong Xing, Qingdao (CN); Lipeng Shao, Qingdao (CN); Minghai Wang, Qingdao (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 0 days.

(21) Appl. No.: 14/839,631

(22) Filed: Aug. 28, 2015

(65) Prior Publication Data

US 2016/0060939 A1 Mar. 3, 2016

Related U.S. Application Data

(63) Continuation-in-part of application No. 14/401,502, filed as application No. PCT/CN2013/075550 on May 13, 2013, now abandoned.

(30) Foreign Application Priority Data

Jun. 13, 2012 (CN) ..... 2012 1 0192426

(51) Int. Cl.
*B66F 7/28* (2006.01)

(52) U.S. Cl.
CPC ..... *B66F 7/28* (2013.01)

(58) Field of Classification Search
CPC ..... E02D 29/14; E04H 5/06; B66F 7/28; E05F 15/60; E05F 15/51; E05F 15/605; B60S 9/02; B60S 9/04
(Continued)

(56) References Cited

U.S. PATENT DOCUMENTS 1,581,832 A * 4/1926 Blockhan ..... E05F 15/605 16/325
2,393,052 A * 1/1946 Mehard ..... E05D 15/262 160/189

(Continued)

FOREIGN PATENT DOCUMENTS

CN 201502198 U 6/2010
CN 102701111 A 10/2012

(Continued)

OTHER PUBLICATIONS

International Search Report of international application No. PCT/CN2013/075550, dated Aug. 29, 2013.

(Continued)

*Primary Examiner* — Gregory Strimbu
(74) *Attorney, Agent, or Firm* — J. C. Patents

(57) ABSTRACT

A segmented inverting cover plate apparatus for an underfloor vehicle lifting jack comprises a cover plate comprising a first movable cover plate (4) and a second movable cover plate (6), wherein the first movable cover plate (4) and the second movable cover plate (6) are pivotly connected via a pin shaft (15). An anti-inversion block (5) is provided directly below the pin shaft (15). A guide wheel (7) is provided below the end of the second movable cover plate (6) away from the first movable cover plate (4). An inverting arm (3) is provided below the first movable cover plate (4), with one end of the inverting arm (3) connected to the anti-inversion block (5) via a bearing (13), the other end of the inverting arm connected to a powered push rod (1) via (Continued)

a pin shaft (17) and an oil-containing bearing (18), and the powered push rod (1) is installed on a powered push rod mounting seat (2).

10 Claims, 5 Drawing Sheets

(58) Field of Classification Search
USPC ..... 160/210; 49/279, 280
See application file for complete search history.

(56) References Cited

U.S. PATENT DOCUMENTS

| | | | | | |
|---|---|---|---|---|---|
| 2,889,875 | A | * | 6/1959 | Turner | E05D 15/262 160/188 |
| 3,614,974 | A | * | 10/1971 | Tajima | E05F 15/51 160/188 |
| 4,010,571 | A | * | 3/1977 | McGuire | B65G 67/02 414/572 |
| 4,193,439 | A | * | 3/1980 | Kummerman | B63B 19/197 114/201 R |
| 4,545,418 | A | * | 10/1985 | List | E05D 15/262 160/207 |

FOREIGN PATENT DOCUMENTS

| | | | | |
|---|---|---|---|---|
| CN | 202609869 | U | | 12/2012 |
| DE | 1 814 224 | | * | 6/1970 |
| DE | 25 07 967 | | * | 9/1976 |
| DE | 35 13 631 | | * | 10/1988 |
| DE | 93 10 791.9 | | * | 1/1995 |
| DE | 94 16 737 | U1 | | 2/1995 |
| EP | 0 240 947 | A1 | | 10/1987 |
| JP | 59-120798 | U | | 8/1984 |
| JP | 05-024814 | U | | 3/1993 |
| JP | H05-24814 | | | 3/1993 |
| JP | H05-024814 | U | | 3/1993 |
| JP | H08-02890 | | | 1/1996 |
| JP | H09-118437 | A | | 5/1997 |
| JP | 10-044945 | A | | 2/1998 |
| SU | 437712 | A2 | | 7/1974 |
| SU | 881278 | A1 | | 11/1981 |

OTHER PUBLICATIONS

The Russian Decision on Grant of corresponding Russia patent application No. 2015100254/11(000494), dated Feb. 9, 2016.
The extended European Search Report, including European Search Opinion of corresponding European patent application No. 13803652.0-1604, dated Dec. 14, 2015.
The notification granting a European patent on application No. 13803652.0-1604, dated Mar. 24, 2016.
The Japanese Examination Report of corresponding Japan patent application No. 2015-514333, dated Jan. 5, 2016.

* cited by examiner

SEGMENTED INVERTING COVER PLATE APPARATUS FOR UNDERFLOOR VEHICLE LIFTING JACK

CROSS-REFERENCE TO RELATED APPLICATION

This application is a continuation-in-part application of, and claims the priority benefit of, U.S. application Ser. No. 14/401,502 with a 371(c) filing date of Nov. 14, 2014, now abandoned, which is a national phase application of international No. PCT/CN2013/075550 filed on May 13, 2013, which in turn claims the priority benefits of Chinese application No. 201210192426.2, filed on Jun. 13, 2012. The entirety of these prior patent applications are hereby incorporated by reference herein and made a part of this specification.

FIELD OF THE INVENTION

The invention relates to railway locomotive repair equipment, in particular to a cover plate apparatus for underfloor vehicle lifting jack used for examining and repairing railway vehicles.

BACKGROUND OF THE INVENTION

The underfloor vehicle lifting jack is used for examination and repair of motor train units, high-speed trains, high-power locomotives or urban rail vehicles which are intact and not dismantled, including replacement of bogies for railway vehicles, examination and repair and replacement of electric installations at the bottom and top of the vehicle bodies, etc. With large-scale use of motor train units and high-speed trains in China, the underfloor vehicle lifting jack for motor train units plays an important role in high-level examination and repair of trains. For unwheeling of a motor train unit, firstly the entire train is synchronously lifted to a certain height by a bogie lift unit and the bogie is disassembled, then the railway carriage is propped up by a vehicle body lift unit.

In the process of unwheeling, both the lift pillar and the propping head part of the vehicle body lift unit elevate above the soil, hence the cover plate at ground level is provided with corresponding openings, which are not only inconvenient for examination and repair, but also bring hidden danger for personal safety of maintainers. Frequently, an inverting cover plate apparatus is used in order to block off these openings without influencing stretching and retraction of the vehicle body lift pillar. A conventional inverting cover plate has the following two structures: (1) the inverting cover plate is directly jacked up by the vehicle body lift unit, and the guide wheel on the inverting cover plate jacked up rolls along the lift pillar; this type of cover plate is applicable in the case that the propping head is basically parallel and level to the lift pillar, but not applicable in the case that the propping head is comparatively long. (2) a per pale inverting cover plate, the inverting cover plate of this structure takes up a large space, thus reducing the space for examination and repair, which is inconvenient for examination and repair of vehicles lifted.

SUMMARY OF THE INVENTION

In allusion to above-mentioned problems of the existing inverting cover plate for underfloor vehicle lifting jack, the invention provides an inverting cover plate apparatus for underfloor vehicle lifting jack which is reliable and practical in structure and safe and convenient in use.

The technical scheme of the invention is as below: a segmented inverting cover plate apparatus for an underfloor vehicle lifting jack comprises a cover plate, wherein the cover plate is of a segmented structure, and comprises a first movable cover plate and a second movable cover plate, the first movable cover plate and the second movable cover plate are hinged by means of a pin shaft; an anti-inversion block is provided directly below the pin shaft, the anti-inversion block being connected to the first movable cover plate by means of another pin shaft.

Preferentially, a guide wheel is provided below the end of the second movable cover plate away from the first movable cover plate.

Preferentially, an inverting arm is provided below the first movable cover plate, one end of the inverting arm is connected to the anti-inversion block by means of a bearing, the other end is connected to a powered push rod by means of a pin shaft and an oil-containing bearing, and the powered push rod is installed on a powered push rod mounting seat.

Preferentially, the powered push rod mounting seat is connected with the first movable cover plate.

Beneficial effect of the invention: the invention adopts a segmented structure, after the lift unit stretches out, the first movable cover plate returns to the horizontal position, the second movable cover plate leans against the lift pillar and touches with the lift pillar by means of the guide wheel. Compared with the existing inverting cover plate, the invention has the advantages as below: (1) in the process of examination and repair, when lifting or descending the lift unit, there is no need to open the inverting cover plate, which is convenient for use; (2) the first movable cover plate closed does not take up finite space for examination and repair, and reduces potential safety hazard for maintainers; (3) the vehicle body lift unit applicable for many types is also applicable to the invention no matter whether the propping head is parallel and level to the lift pillar.

DETAILED DESCRIPTION OF THE EMBODIMENTS

Figure 1:
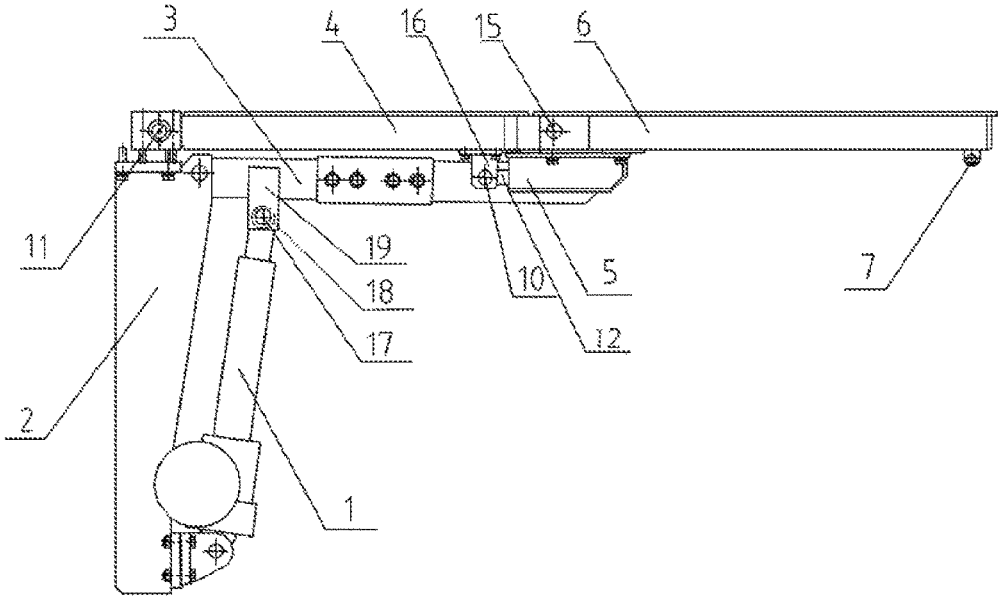
FIG. 1 is a structural diagram of a segmented inverting cover plate apparatus according to an embodiment of the invention.

Further description of the invention is made in combination with the accompanying drawings.

A segmented inverting cover plate apparatus for an underfloor vehicle lifting jack is provided, which comprises a cover plate, wherein the cover plate is of a segmented structure, and comprises a first movable cover plate 4 and a second movable cover plate 6, the first movable cover plate 4 and the second movable cover plate 6 are hinged by means of a pin shaft 15; and a guide wheel 7 is provided below the end of the second movable cover plate 6 away from the first movable cover plate 4. An anti-inversion block 5 is provided directly below the pin shaft 15. An inverting arm 3 is provided below the first movable cover plate 4, one end of the inverting arm 3 is connected to the anti-inversion block 5 by means of two bearings, the other end is connected to a powered push rod 1 by means of the pin shaft 17 and an oil-containing bearing 18, and the powered push rod 1 is installed on a powered push rod mounting seat 2. The powered push rod mounting seat 2 is connected with the first movable cover plate 4.

The working principle of the segmented inverting cover plate apparatus for an underfloor vehicle lifting jack is as follows: at off-working state, the inverting cover plate is at a horizontal position.

When the propping head 8 and the lift pillar 9 of the vehicle body lift unit elevate above the soil, the inverting cover plate begins working: (1) driven by the powered push rod 1, the inverting arm 3 drives the first movable cover plate 4 and the second movable cover plate 6 to move until inverting nearly 90 degrees; (2) the propping head 8 and the lift pillar 9 of the vehicle body lift unit raise up; (3) the powered push rod 1 drives the inverting arm 3 to retract, the guide wheel 7 on the inverting cover plate touches with lift pillar 9, the first movable cover plate 4 returns to the horizontal position, and the second movable cover plate 6 leans against the lift pillar 9.

Figure 2:
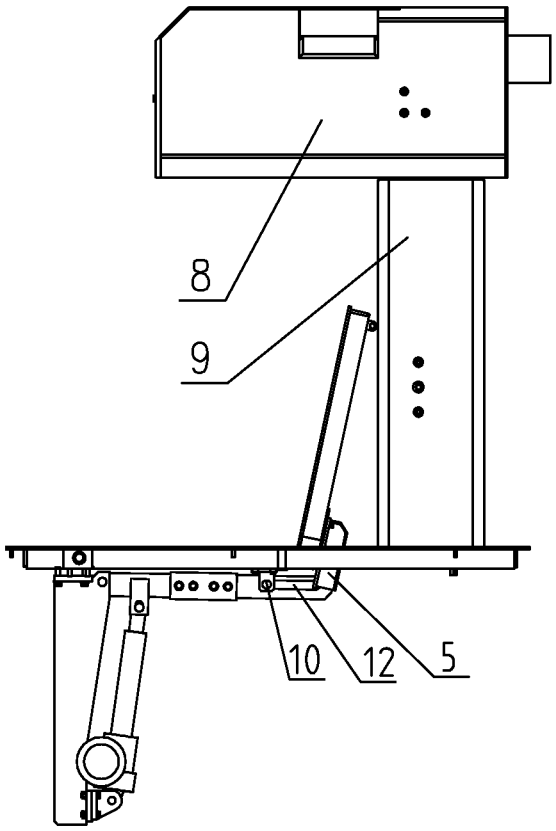
FIG. 2 is a structural diagram of the segmented inverting cover plate apparatus shown in FIG. 1 at the working state.
Figure 3:
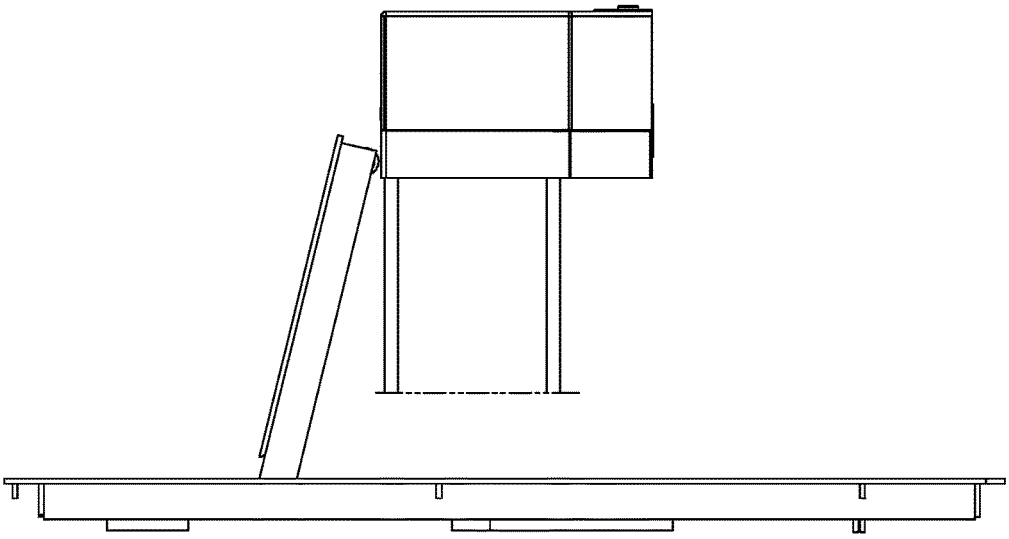
Fig. 3 (Prior Art)
FIG. 3 is a structural diagram of a conventional inverting cover plate apparatus at the working state.
Figure 4:
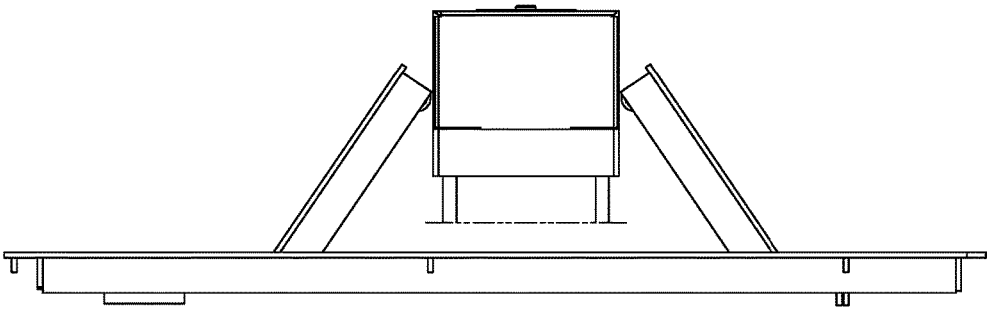
Fig. 4 (Prior Art)
FIG. 4 is a structural diagram of another conventional inverting cover plate apparatus at the working state.
Figure 5:
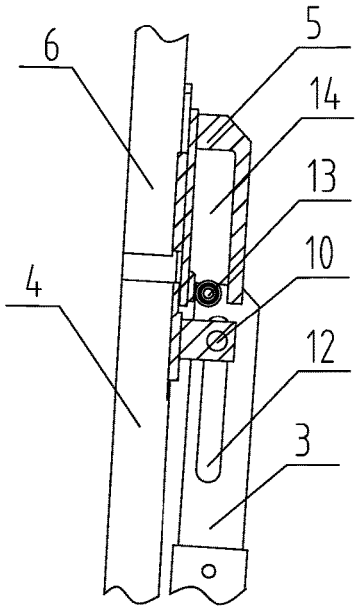
FIG. 5 is a partial sectional view showing a section of the segmented inverting cover plate apparatus according to an embodiment of the invention.

A segmented inverting cover plate apparatus for an underfloor vehicle lifting jack includes a cover plate of a segmented structure, i.e., the cover plate includes two or more plates movably connected to each other. In the embodiment as shown in FIGS. 1, 2, and 5, the cover plate includes a first movable cover plate 4 and a second movable cover plate 6. The first movable cover plate 4 and the second movable cover plate 6 are hinged, for example, by means of a pin shaft 15, so that the first movable cover plate 4 and the second movable cover plate 6 can pivot relative to each other around the pin shaft 15. The first and second movable cover plates 4 and 6 and the pin shaft 15 extend in the direction perpendicular the paper as viewed in FIG. 1. A guide wheel 7 is provided on the lower surface of the second movable cover plate 6 at the end of the second movable cover plate 6 away from the first movable cover plate 4. An anti-inversion block 5 is provided directly below the pin shaft 15 and fixedly connected to the lower surface of the second movable cover plate 6. The anti-inversion block 5 serves to prevent the second movable cover plate 6 from clockwise pivoting relative to the first movable cover plate 4 when the two cover plates are in a coplane state, and to prevent the second movable cover plate 6 from counterclockwise pivoting relative to the first movable cover plate 4 when raising the two cover plates from a horizontal state. An inverting arm 3 is provided below the first movable cover plate 4, one end of the inverting arm 3 is slidably connected to the first movable cover plate 4, for example, via a pin shaft 10 and a pin shaft seat 16. The pin shaft seat 16 is fixed on the lower surface of the first movable cover plate 4 at the end of the first movable cover plate 4 near the pin shaft 15. The pin shaft seat 16 has two arms holding the pin shaft 10 therebetween. The inverting arm 3 is provided with a groove 12 which transversely penetrates the inverting arm 3 and extends along the longitudinal direction of the inverting arm 3 as shown in FIG. 5. The pin shaft 10 is inserted in the groove 12, so that the pin shaft 10 can slide in the groove 12 in the longitudinal direction of the inverting arm 3. The other end of the inverting arm 3 is pivotly connected to a powered push rod 1, for example, by means of a pin shaft 17 and an oil-containing bearing 18. The oil-containing bearing 18 is sleeved on the pin shaft 17. A pin shaft seat 19 is fixed on the inverting arm 3, the pin shaft seat 19 has two arms holding the pin shaft 17 and the oil-containing bearing 18 therebetween. The powered push rod 1 is installed on a powered push rod mounting seat 2. The powered push rod mounting seat 2 includes a base for installing the powered push rod 1 and an upward extending body which pivotly connects with the first movable cover plate 4 at the top portion thereof, for example via a pin shaft 11. The other end of the inverting arm 3 far away from the anti-inversion block 5 may extend beyond the pin shaft seat 19 to the powered push rod mounting seat 2. Optionally, when the first movable cover plate 4 and the second movable cover plate 6 are in the horizontal position, this end of the inverting arm 3 may abut the sidewall of the upward extending body of the powered push rod mounting seat 2, which provides additional support for the first movable cover plate 4 and the second movable cover plate 6 in the horizontal position via the inverting arm 3 and the pin shaft seat 16 (at this position, pin shaft 10 may abut the left end of the groove 12 as viewed in FIG. 1).

The first movable cover plate 4 is pivotly connected with the powered push rod mounting seat 2, for example, via a pin shaft and a pin shaft seat positioned at the top of its upward extending body (See FIG. 1). The end of the inverting arm 3 away from the powered push rod 1 is slidably connected with the anti-inversion block 5.

The anti-inversion block 5 has an elongated body, extending along a direction perpendicular to the pin shaft 15. One end of the anti-inversion block 5 can be fixedly connected to the lower surface of the second movable cover plate 6, or the anti-inversion block 5 and the second movable cover plate 6 can be made integrally. The other end of the anti-inversion block 5 extends to below the lower surface of the first movable cover plate 4. When the first movable cover plate 4 and the second movable cover plate are in a coplane state, the upper surface of the anti-inversion block 5 at the other end may or may not contact the lower surface of the first movable cover plate 4.

Figure 6:
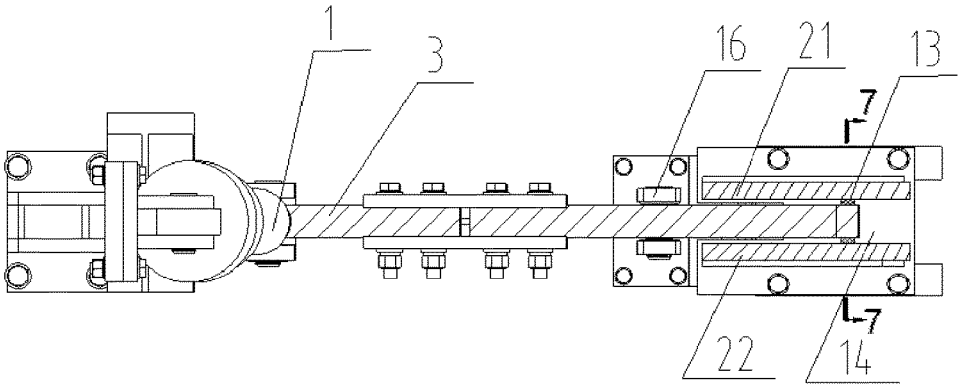
FIG. 6 is a bottom view of the segmented inverting cover plate apparatus according to an embodiment of the invention.
Figure 7:
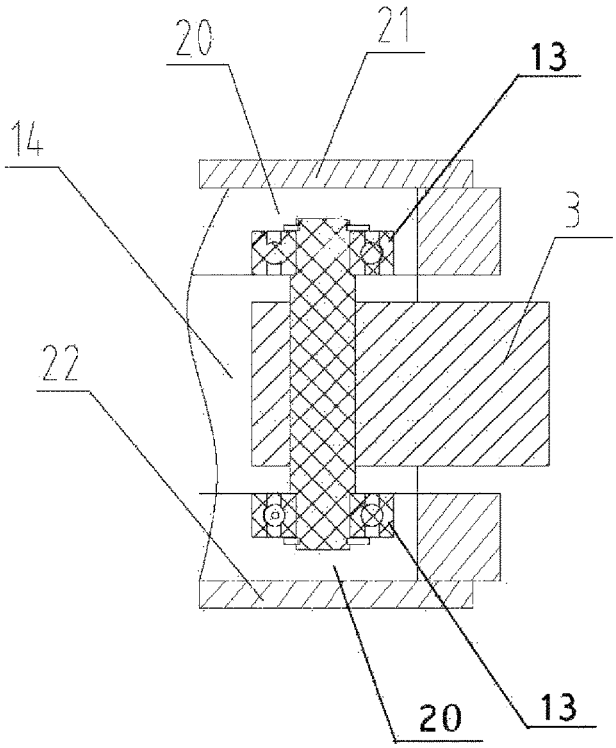
FIG. 7 is a sectional view along 7-7 in FIG. 6.

As shown in FIGS. 5 and 6, the anti-inversion block 5 has two parallel arranged side blocks 21 and 22. An elongated hollow groove 14 is defined between the two side blocks 21 and 22, extending in the longitudinal direction of the anti-inversion block 5. The elongated hollow groove 14 may be open downwardly, i.e., the bottom part of the side blocks 21 and 22 is uncovered. The anti-inversion block 5 may also have a bottom wall covering the elongated hollow groove 14 from the bottom. The inverting arm 3 is inserted into the elongated hollow groove 14 and can slide in the elongated hollow groove 14 in the longitudinal direction.

On the upper portion of the inner wall of each side block 21 and 22, an elongated hollow groove 20 is formed, extending in the longitudinal direction of the anti-inversion block 5. Each elongated hollow groove 20 runs parallel with, and opens to, the elongated hollow groove 14. A pair of bearings 13 is fixed to the end of the inverting arm 3. Each bearing 13 is positioned in a corresponding elongated hollow groove 20 and, when the bearing 13 slides in the corresponding elongated hollow groove 20, the inverting arm 3 slides in the elongated hollow groove 14 with the bearings 13. The elongated hollow groove 20 gradually becomes broader in the direction from the end close to the inverting arm 3 to the end away from the inverting arm 3, or at least within the portion at the end close to the inverting arm 3 gradually becomes broader. The side blocks 21 and 22 can be directed connected to the lower surface of the second movable cover plate 6, or a top wall can be provided to cover the side blocks 21 and 22, and the top wall and the side blocks 21 and 22 together define the elongated hollow groove 20. At the narrow end of the elongated hollow groove 20, the bearing 13 is tightly held by the elongated hollow groove 20 so that the bearing 13 cannot move relative to the anti-inversion block 5 (See FIG. 5). While in broader portions of the elongated hollow groove 20, the bearing 13 can move relative to the anti-inversion block 5. In the portion of the anti-inversion block 5 that extends beyond the edge of the second movable cover plate 6, the elongated hollow groove 14 is open upwardly, i.e., exposes to the lower surface of the first movable cover plate 4, so that this end of the inverting arm 3 can pivot relative to the second movable cover plate 6 around the bearings 13.

The working principle of the segmented inverting cover plate apparatus for an underfloor vehicle lifting jack is as follows: at off-working state, the inverting cover plate is at the level or horizontal position. At this position, pin shaft 10 abuts the left end of the groove 12 as shown in FIG. 1.

When the propping head 8 and the lift pillar 9 of the vehicle body lift unit elevate above the ground, the inverting cover plate begins to work: (1) the powered push rod 1 extends upward and drives the inverting arm 3 to pivot around pin shaft 17, the inverting arm 3 drives the first movable cover plate 4 and the second movable cover plate 6 to move until inverting nearly 90 degrees, at this position the bearing 13 moves to the narrow end of the elongated hollow groove 20 and is tightly held by the elongated groove 20, and the pin shaft 10 moves to the right end or upper end of the groove 12 (See FIG. 5), which prohibits the second movable cover plate 6 from rotating counterclockwise relative to the first movable cover plate 4 as viewed perpendicular to the paper in FIG. 5; (2) the propping head 8 and the lift pillar 9 of the vehicle body lift unit stretch out; (3) the powered push rod 1 retracts and drives the inverting arm 3 to pivot reversely, the bearing 13 moves away from the narrow end of the elongated hollow groove 20 and, when the bearing 13 moves close to or beyond the pin shaft 15, that allows the anti-inversion block 5 to pivot relative to the inverting arm 3 around the bearings 13 and, thus, allows the second movable cover plate 6 to pivot counterclockwise relative to the first movable cover plate 4; the guide wheel 7 on the inverting cover plate touches with lift pillar 9, the first movable cover plate 4 returns to the horizontal position, and the second movable cover plate 6 leans against the lift pillar 9. At this position, pin shaft 10 abuts the left end of the groove 12 again as shown in FIG. 2.

What is claimed is:

1. A segmented inverting cover apparatus for an underfloor vehicle lifting jack, comprising:

a cover, wherein the cover comprises a first movable cover plate and a second movable cover plate, the first movable cover plate and the second movable cover plate are pivotly connected to each other via a first pin shaft;

an anti-inversion block being directly below the first pin shaft when the cover is in a horizontal closed position, the anti-inversion block being mounted to a lower surface of the second movable cover plate; and an inverting arm positioned below the first movable cover plate when the cover is in the horizontal closed position, wherein one end of the inverting arm is slidably connected with the anti-inversion block, another end of the inverting arm is connected to a powered push rod, and the inverting arm is also slidably connected to the first movable cover plate;

wherein the anti-inversion block has two side blocks extending parallel to one another and defining a first elongated hollow groove therebetween which extends in a direction perpendicular to the first pin shaft and slidably receives said one end of the inverting arm.

2. The segmented inverting cover apparatus for an underfloor vehicle lifting jack according to claim 1, wherein a guide wheel is provided below one end of the second movable cover plate when the cover is in the horizontal closed position.

3. The segmented inverting cover apparatus for an underfloor vehicle lifting jack according to claim 1, wherein the powered push rod is installed on a powered push rod mounting seat.

4. The segmented inverting cover apparatus for an underfloor vehicle lifting jack according to claim 3, wherein the powered push rod mounting seat is pivotly connected with the first movable cover plate.

5. The segmented inverting cover apparatus for an underfloor vehicle lifting jack according to claim 1, wherein each of the two side blocks includes a second elongated hollow groove extends parallel with, and opens to, the first elongated hollow groove.

6. The segmented inverting cover apparatus for an underfloor vehicle lifting jack according to claim 5, wherein a bearing is fixed to said one end of the inverting arm and is slidably received in one of the second elongated hollow grooves.

7. The segmented inverting cover apparatus for an underfloor vehicle lifting jack according to claim 6, wherein a height of each of the second elongated hollow groove varies in a direction perpendicular to the first pin shaft.

8. The segmented inverting cover apparatus for an underfloor vehicle lifting jack according to claim 1, wherein one end of the anti-inversion block extends below a lower surface of the first movable cover plate when the cover is in the closed position.

9. The segmented inverting cover apparatus for an underfloor vehicle lifting jack according to claim 1, wherein the inverting arm is slidably connected to the first movable cover plate via a second pin shaft and a pin shaft seat; the pin shaft seat is fixed on a lower surface of the first movable cover plate, the pin shaft seat has two arms holding the second pin shaft therebetween; the inverting arm is provided with a groove extending along a longitudinal direction of the inverting arm; the second pin shaft is inserted in the groove of the inverting arm, so that the second pin shaft can slide in the groove of the inverting arm.

10. A segmented inverting cover apparatus for an underfloor vehicle lifting jack, comprising:

a cover, wherein the cover comprises a first movable cover plate and a second movable cover plate, the first movable cover plate and the second movable cover plate are pivotly connected to each other via a first pin shaft;

an anti-inversion block being directly below the first pin shaft when the cover is in a horizontal closed position, the anti-inversion block being mounted to a lower surface of the second movable cover plate; and an inverting arm positioned below the first movable cover plate when the cover is in the horizontal closed position, wherein one end of the inverting arm is slidably connected with the anti-inversion block, another end of the inverting arm is connected to a powered push rod, and the inverting arm is also slidably connected to the first movable cover plate;

wherein the inverting arm is slidably connected to the first movable cover plate via a second pin shaft and a pin shaft seat; the pin shaft seat is fixed on a lower surface of the first movable cover plate, the pin shaft seat has two arms holding the second pin shaft therebetween; the inverting arm is provided with a groove extending along a longitudinal direction of the inverting arm; the second pin shaft is inserted in the groove of the inverting arm so that the second pin shaft can slide in the groove of the inverting arm.

* * * * *